US006861601B2

(12) United States Patent
Heien

(10) Patent No.: US 6,861,601 B2
(45) Date of Patent: Mar. 1, 2005

(54) MECHANICAL DELAY TIMER

(76) Inventor: Troy A. Heien, 5704 S. View Rd., Laramie, WY (US) 82070

( * ) Notice: Subject to any disclaimer, the term of this patent is extended or adjusted under 35 U.S.C. 154(b) by 0 days.

(21) Appl. No.: 10/788,719

(22) Filed: Feb. 27, 2004

(65) Prior Publication Data

US 2004/0168897 A1 Sep. 2, 2004

Related U.S. Application Data

(60) Provisional application No. 60/450,802, filed on Feb. 27, 2003.

(51) Int. Cl.[7] ..... H01H 7/08

(52) U.S. Cl. ..... 200/331; 200/38 R

(58) Field of Search ..... 200/33 A, 33 B, 200/33 C, 33 D, 33 R, 331, 332.1, 37 R, 35 W, 37 A, 38 R, 38 A, 38 B, 38 BA, 38 FA, 38 FB, 38 C, 38 CA

(56) References Cited

U.S. PATENT DOCUMENTS

| | | | | | |
|---|---|---|---|---|---|
| 1,922,868 | A | | 8/1933 | Rucker | |
| 2,937,247 | A | | 5/1960 | Laviana et al. | |
| 3,179,396 | A | | 4/1965 | Bracken | |
| 3,710,045 | A | * | 1/1973 | Jochim | 200/37 R |
| 3,818,156 | A | | 6/1974 | Augustyniak | |
| 4,206,327 | A | * | 6/1980 | Lindsay | 200/33 R |
| 4,319,101 | A | * | 3/1982 | Bolin | 200/38 R |
| 4,464,548 | A | * | 8/1984 | Burmeister | 200/33 R |
| 4,752,656 | A | * | 6/1988 | Song | 200/38 R |
| 4,835,413 | A | | 5/1989 | Nilssen | |
| 4,912,376 | A | | 3/1990 | Strick | |
| 5,719,362 | A | | 2/1998 | Gray | |
| 6,710,274 | B2 | * | 3/2004 | Whetzel et al. | 200/331 |

* cited by examiner

*Primary Examiner*—Lincoln Donovan
*Assistant Examiner*—M. Fishman
(74) *Attorney, Agent, or Firm*—Roland H. Shubert

(57) ABSTRACT

A timer for delaying the operation of a toggle switch for a pre-set interval includes a mechanical, spring powered timer which drives a cam that engages the toggle of a conventional wall switch to move the toggle from one position to another. The timer is contained within a housing which, in turn, detachably connects to a housing floor that is mounted over the toggle switch cover plate.

11 Claims, 2 Drawing Sheets

MECHANICAL DELAY TIMER

REFERENCE TO RELATED APPLICATION

This application claims the benefit of U.S. Provisional Patent Application No. 60/450,802 that was filed on Feb. 27, 2003.

BACKGROUND OF THE INVENTION

1. Technical Field

This invention relates to a mechanical delay timer that is arranged to turn a toggle switch on or off after a predetermined interval.

More particularly, this invention relates to a delay timer that may be mounted upon a conventional wall switch without modification of the switch in any way.

2. Description of Related Art

There are a number of mechanical and electrical devices known in the prior art that function to turn a switch on or off at a preset time or after a delay interval. Examples of such prior art devices include those described in U.S. Pat. Nos. 5,719,362; 4,912,376; 4,835,413; 3,818,156; 3,179,396; 2,937,247 and 1,922,868. However, none of the known prior art devices offer the convenience, ease of installation, and simple mechanical dependability as does the timer disclosed herein.

SUMMARY OF THE INVENTION

The delay timer of this invention includes a mechanical, spring-driven timer means that is arranged to impart rotary movement to a cam plate. A pair of upstanding rails are spaced apart on a surface of the cam plate to define a spiral cam track that accepts the lever of a conventional toggle switch. Rotation of the cam plate imparted by the timer causes the toggle switch lever to move downward or upward within the cam track to thereby turn the switch off or on after a preset interval. The timer means and cam plate are mounted within a housing that preferably snap-connects to a housing floor, or base, which in turn is attached to an existing switch plate using the switch plate mounting screws for attachment.

It is therefore an object of this invention to provide a simple and reliable delay timer that can be easily mounted upon an existing toggle switch without modification or disassembly of the switch.

Other objects and advantages of this invention will become evident from the following disclosure and description of certain preferred embodiments.

DESCRIPTION OF PREFERRED EMBODIMENTS OF THE INVENTION

Figures 1, 2, 3:
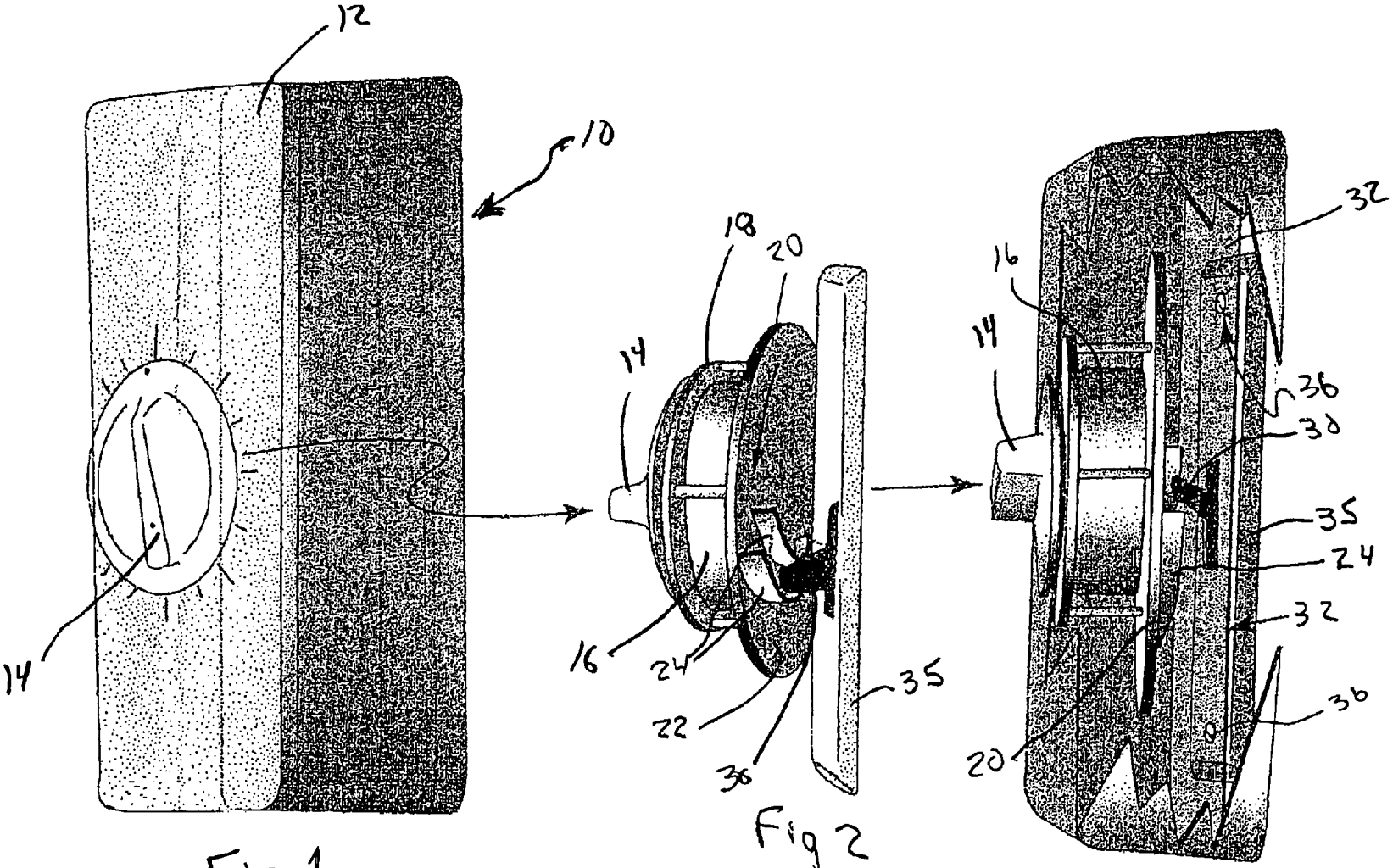
FIG. 1 is an oblique external view of the delay timer of this invention showing the housing and controls.
FIG. 2 is a partially rotated, oblique elevation view of the timer means, cam, and cam plate in association with a toggle switch.
FIG. 3 is a partially cut-away view of the delay timer mounted upon a conventional toggle switch.
Figure 4:
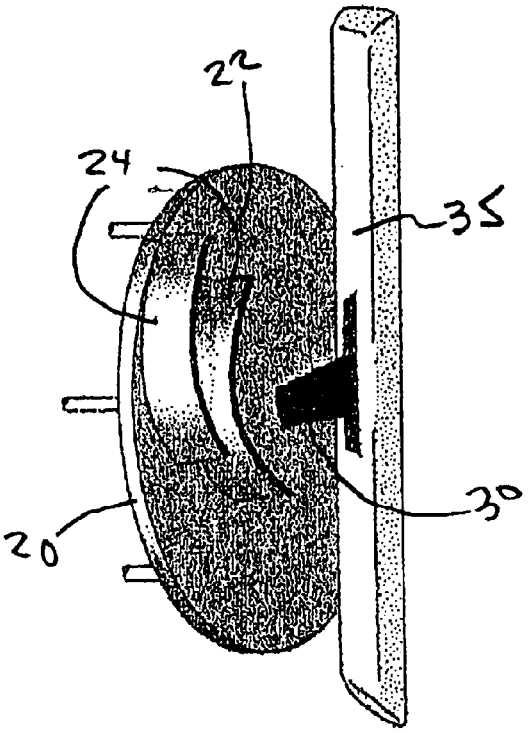
FIG. 4 is an oblique elevation view of the cam plate and cam rails in association with a toggle switch.

The delay timer of this invention will be described with reference to the Figures wherein FIG. 1 shows the delay timer generally at 10. Timer 10 includes an external housing 12 having a timer set control 14 on the front thereof. As is better illustrated in FIGS. 2 and 3, rotation of set control 14 serves to tension the power spring 16 of timer means 18. Timer means 18 may conveniently comprise the same operating mechanism as is used in kitchen and other short-interval timers. Alternatively, the timer means 18 may comprise a spring driven music box, and may be arranged such that the music ends as the toggle switch lever turns the switch off or on.

Figure 5:
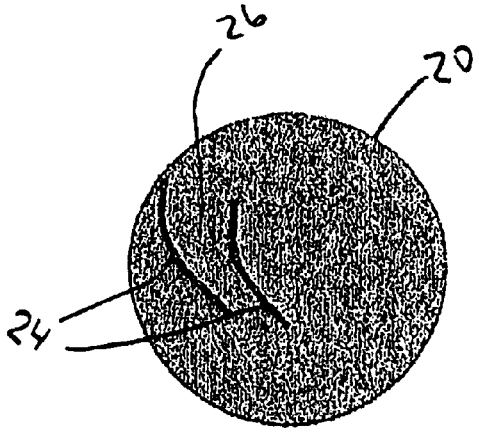
FIG. 5 is a plan view of the toggle plate.

A cam plate 20 is fixed to and is caused to rotate at a pre-determined rate by timer means 18 upon tensioning of the power spring 16 by rotation of the set control. Cam plate 20 is preferably circular, and is provided with a flat surface 22 having a pair of upstanding cam rail means 24 fixed thereto. Cam rails 24 are arranged to form an inwardly spiraling, constant width, cam track 26, which is best seen in FIG. 5. The cam rails 24 are spaced such that the lever 30 of a conventional toggle switch fits loosely there between and is caused to move downwardly or upwardly as the cam plate rotates.

The delay timer of this invention is shown mounted to a conventional household toggle switch in the partially cut-away view of FIG. 3. The exterior housing 12 preferably includes a detachable back member 32 that is constructed to snap on and off of the main part of the housing. Back member 32 is provided with holes that align with the mounting screws 36 for switch plate 35 and is provided as well with an opening for toggle switch lever 30 to extend therethrough. Back member 32 is attached to the switch plate 35 using mounting screws 36. Housing 12 is then snapped into place on the back member making sure that the toggle switch lever 30 is engaged within the track defined by rails 24.

Figure 6:
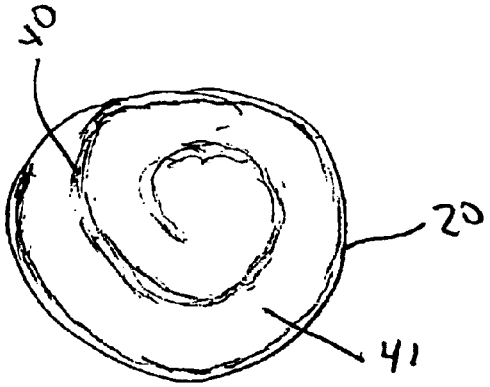
FIG. 6 is a plan view of the toggle plate showing an alternative arrangement of the cam rails.

FIG. 6 shows another embodiment of cam plate 20. In this embodiment, the pair of cam rails 24, shown in FIG. 5, is replaced by a single, continuous, upstanding rail 40 that spirals inwardly from the edge of the cam plate toward its center so as to form a cam channel or track 41 of constant width. This embodiment offers advantage in that it avoids installation error.

As may be appreciated from the foregoing description, this invention provides a simple and versatile delay timer that can easily be installed to operate in association with conventional toggle wall switches. It has been described in relation to preferred embodiments thereof that are illustrated in the drawing Figures. It is to be understood that variations and modifications of the invention, other than those specifically described, will be apparent to those skilled in the art and are included within the scope of the invention.

I claim:

1. A mechanical delay timer for moving the lever of a toggle switch to thereby turn the switch on or off, comprising:

a rotatable cam plate having a flat surface;

rail means extending outwardly from said surface, said rail means positioned on the plate to form a generally spiral cam track that is arranged to engage said switch lever;

a spring powered timer means arranged to rotate said cam plate at a predetermined rate; and means to mount said timer to the switch with said switch lever positioned within said cam track thereby causing said switch lever to move up or down as the cam plate rotates.

2. The timer of claim 1 wherein said rail means comprise two separate rails arranged to form an inwardly spiraling cam track of constant width.

3. The timer of claim 1 including a housing that encases the cam plate and is arranged to attach to a surface mounted toggle switch.

4. The timer of claim 3 wherein said toggle switch has a screw-mounted switch plate and wherein said housing includes a housing body and a detachable back member that is provided with holes aligned with those of said switch plate, said back member also having an opening for the lever of said toggle switch.

5. The timer of claim 4 wherein the housing body and the back member are detachable and are arranged to snap together or apart.

6. The timer of claim 5 wherein the back member is mounted atop said switch plate using the switch plate mounting screws.

7. The timer of claim 1 wherein said rail means comprise a single, upstanding, continuous rail member that spirals inwardly from the edge of the cam plate toward its center to form a cam track of constant width.

8. The timer of claim 1 including a music box that plays as the cam plate rotates.

9. A mechanical delay timer for turning a toggle switch on or off, comprising:

a rotatable cam plate having rail means extending outwardly therefrom and positioned on said plate to form a generally spiral cam track of uniform width that is arranged to engage a lever operating said toggle switch so as to move the lever upward or downward as the cam plate rotates;

a spring powered timer arranged to rotate said cam plate at a predetermined rate for a set time; and means to mount said timer on said toggle switch.

10. The timer of claim 9 wherein said rail means comprise two separate and parallel rails.

11. The timer of claim 9 wherein said rail means comprise a single, upstanding, continuous rail member that spirals inwardly from the edge of the cam plate toward its center to form a cam track of constant width.

* * * * *